United States Patent [19]

Bachle

[11] 4,355,852

[45] Oct. 26, 1982

[54] LAY-IN LUG WITH CONDUCTION PAD

[75] Inventor: Walter W. Bachle, Harwinton, Conn.

[73] Assignee: General Signal Corporation, Stamford, Conn.

[21] Appl. No.: 207,847

[22] Filed: Nov. 18, 1980

[51] Int. Cl.[3] ..... H01R 4/66

[52] U.S. Cl. ..... 339/14 R; 339/264 R; 339/272 R; 339/14 L

[58] Field of Search ..... 339/14 R, 14 L, 251, 339/272R, 272 UC, 264 R

[56] References Cited

U.S. PATENT DOCUMENTS

| | | | |
|---|---|---|---|
| 3,365,693 | 1/1968 | Browne | 339/14 L |
| 3,706,959 | 12/1972 | Norden | 339/14 R |
| 3,967,872 | 7/1976 | Mooney et al. | 339/14 L |
| 4,189,198 | 2/1980 | Reichman | 339/14 L |
| 4,248,490 | 2/1981 | Bachle | 339/14 R |

FOREIGN PATENT DOCUMENTS

| | | | |
|---|---|---|---|
| 971877 | 3/1959 | Fed. Rep. of Germany | 339/264 R |

*Primary Examiner*—Joseph H. McGlynn
*Assistant Examiner*—Frank H. McKenzie, Jr.
*Attorney, Agent, or Firm*—George W. Killian; Milton E. Kleinman

[57] ABSTRACT

A lay-in lug to be coupled to a bushing, or the like, for providing a low resistance grounding connection between a wire secured in the lug and the bushing. The lug comprises a body member and a conduction member for providing strength and a low resistance conduction path, respectively. The body member supports the conduction member and includes resilience to compensate for cold flow of the laid-in wire. The conduction member is in direct contact with both the laid-in wire and the bushing to provide superior conduction between the wire and the bushing. In addition, the wire is pressed against one side of the back portion of the body member and the reverse side of the back of the body member is in direct contact with a back section of the conduction member. Although the conductivity of the body member is not as good as that of the conduction member, the resistance through the back of the body member between the wire and the back of the conduction member is not large due to the fact that the path is short and the cross-sectional area is relatively large. The body and conduction member are fabricated with appropriate proportions and angles to encourage controlled deformation of the conduction member as the lug is attached to the bushing and to assure improved conduction of the combination and good support for the conduction member.

15 Claims, 18 Drawing Figures

FIG. 3
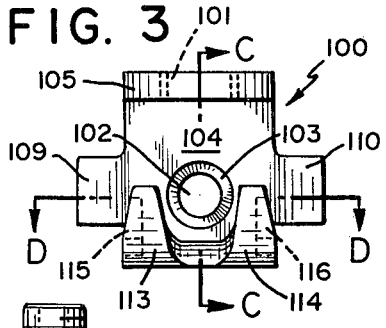
FIG. 3A
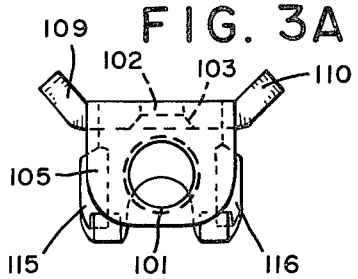
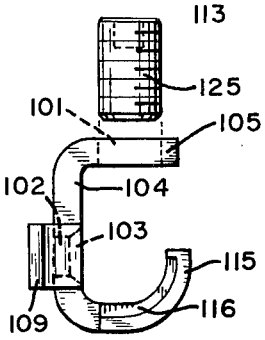
FIG. 3B
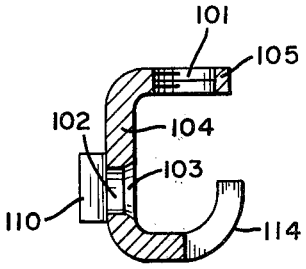
FIG. 3C
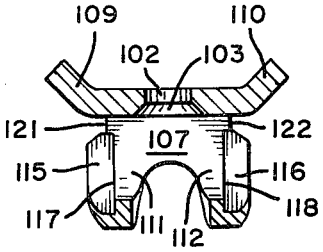
FIG. 3D
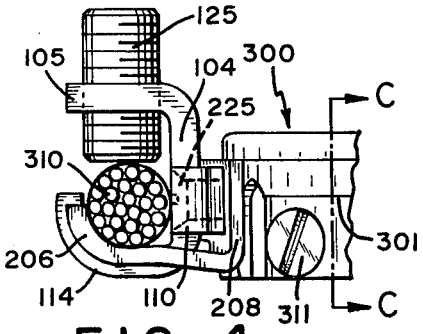
FIG. 4
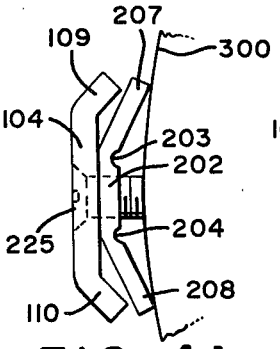
FIG. 4A
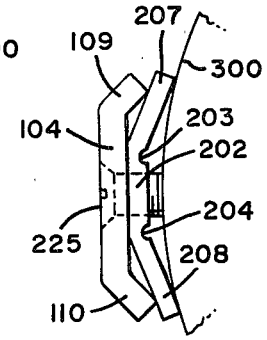
FIG. 4B
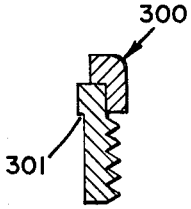
FIG. 4C
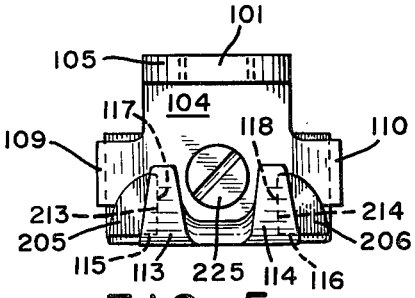
FIG. 5

LAY-IN LUG WITH CONDUCTION PAD

BACKGROUND OF THE INVENTION

Typical lay-in lugs have a "C" shape to permit laying in a wire. Such lugs may be used in a wide variety of applications and are especially well suited for use as a grounding device for electrical equipment such as bushings, or the like, and will be particularly described as used in this manner. Lay-in lugs for electrical fittings are disclosed in U.S. Pat. No. 3,365,693, issued Jan. 23, 1968 to Frank L. Browne; U.S. Pat. No. 3,706,959, issued Dec. 19, 1972 to Alexander R. Norden; and 4,248,490 issued Feb. 3, 1981 to Walter W. Bachle; all of which are assigned to the same assignee as the present invention. Grounding lugs are provided to facilitate the grounding of exposed metallic surfaces such as a conduit and/or other electrical fittings. The grounding connection is frequently made through a bushing which may be threaded onto the end of a conduit as at a service box where the conduit passes through a wall of the box. Grounding lugs of the type under consideration are generally secured to the periphery of the bushing by one or more support screws. The "C" shape is used to allow lay in of the grounding wire without requiring the wire to be cut. A suitable lug should have several characteristics including: (a) "C" shape to permit lay in of grounding wire; (b) minimum size to permit efficient space utilization; (c) resilience to assure adequate pressure after cold flow of the wire; (d) high yield strength to provide adequate wire clamping pressure on the wire; (e) low resistance to reduce heating in response to fault currents; (f) means for preventing lug rotation in response to mounting or securing the wire and other features familiar to those skilled in the applicable arts. Not all of these characteristics are compatible. For example, low resistance tends to mean large size which conflicts with minimum size. High yield strength conflicts with good conductivity. As shown in the cited Bachle patent, the required characteristics may be provided by providing a lug comprising two elements, one of which provides items c and d and the other of which provides item e, while the combination satisfies the remaining requirements. Under ground fault conditions, a very large ground current may pass through the grounding wire and the lug; and therefore, it is important that the lug provide a suitable, low-resistance connection. Under fault conditions, the ground current may rise to thousands of amperes. Unless good conductivity is provided between the grounding wire and the bushing, the large current may cause sufficient heat to melt or even vaporize the lug and/or the supporting screws. This may result in loss of the grounding connection, circuit failure, danger to personnel, and equipment damage or fire. Accordingly, efforts have been made to improve the conductivity between the grounding wire and the bushing, or the like. Prior art devices have, for the most part, attempted to provide the desired low resistance by providing more massive lugs and/or larger areas of contact together with large supporting screws. In order to reduce the size of the lug and to provide a suitably resilient connector, the devices must be made of high strength material so that the lug will not yield appreciably when a wire or cable is securely tightened by the wire holding screw. Unfortunately, materials with high yield strength have poor conductivity as compared with good conductors such as copper, aluminum, or their alloys. Therefore, lugs made from high strength materials are subject to significant internal heating in response to the presence of a large fault current. The large currents, frequently encountered in the field under ground fault conditions, severely limit the utility of grounding lugs which have a high internal resistance for two reasons. One is that the connector will become hot while passing a large current because of the internal resistance of the connector material and thereby cause it to melt and destroy the connector, which results in a discontinuity of the electrical grounding circuit. Another limitation is the result of the fault current being passed through the connector's mounting screw, causing the screw to heat and melt and thereby break the grounding circuit. This is a direct result of current being shunted through the screw, since the alternate current paths through the connector's body have a high resistance and the current will always seek the path of least resistance.

The Bachle patent discloses a lug comprising a support member and a conduction member. The Bachle lug has proved adequate and reliable in many applications. However, for selected applications and even larger ground fault currents, it is desirable to provide improved conductivity and multiple electrical paths.

SUMMARY OF THE INVENTION

The structure of the present invention overcomes the difficulties and disadvantages of the prior art and constitutes an improvement on the structure disclosed in the Bachle patent by providing a grounding lug comprising two major components; one of which provides the requisite strength while the other provide a major conduction path and in combination with the first member provides an alternate conduction path. The conduction member is formed and oriented so that it is supported by the strong body member; and yet, it is in direct contact with both the ground wire and the bushing, or the like, on which the the lug structure is mounted. In addition, when the laid-in wire is secured to the lug, it is caused to contact a surface of the support member whose other side is in direct contact with the conduction member. Accordingly, because of the pressure between the two members and the relatively large area of contact therebetween, as compared with the thickness of the support member, there is an additional conduction path from the laid-in wire through the thickness of the support member to the conduction member. Inasmuch as the conduction member has the requisite conductivity, or low resistance, it will not heat excessively in response to large currents. In addition, alternate conduction paths are provided to help minimize the current density and heating as the current passes through any single conduction path. The body member may comprise a suitable ferrous alloy such as stainless steel, and the conducting member may comprise copper or a suitable conductive alloy and may be tin plated or otherwise treated to inhibit the formation of oxides which have a high resistance and would therefore be detrimental. A first fastening means, such as one or more screws, is provided to secure the body member and the associated conduction member to the bushing, or the like, in a predetermined relationship such that mating surfaces on the members are brought into mutual contact. In response to further tightening of the fastening means, the conduction member undergoes mild deformation along predetermined lines and causes wings of the conduction member to come in contact with wings of the support member which squeeze the conduction wings between the support wings and the bushing, or the like. In the embodiment shown, the support member and the conduction member both include turned-up legs to help retain the grounding wire in the lug assembly and urge the grounding wire towards contact with the back of the support member. At least a part of the legs of the conduction member are rigidly supported by at least a part of the legs of the support member. A second fastening means secures and clamps the grounding wire in firm contact with the legs of the conduction member and the back of the support member. Serrations and/or controlled configuration of the legs may be employed to improve the contact and grip between the grounding wire and the lug members. Because of the relative shape and configuration of the legs of the support and conduction member, the laid-in wire undergoes some deformation in response to tightening of the appropriate screw thereby helping to increase the pull-out force required to pull the wire from the lug.

In a typical use of the lay-in lug, it will be attached to the bushing at the time the bushing is installed. Because it saves space to have bushings close together, or close to other apparatus, it is desirable to provide a bushing and lug assembly with the smallest possible maximum turning radius. This desirable feature has been achieved through the effective use of a high strength body member and a low resistance conduction member associated in cooperative relationship.

OBJECTS OF THE INVENTION

From the foregoing it will be appreciated that:

It is a primary object of the invention to provide a new and improved grounding lug.

It is a more specific object of the invention to provide a grounding lug with improved conductivity.

It is another object of the invention to provide a grounding lug with improved conductivity and without any loss of strength or increase in size.

It is another object of the invention to provide a grounding lug which can pass fault currents without being destroyed.

It is another object of the invention to provide a grounding lug which includes a support member and a conduction member with the conduction member in direct contact with both the wire and the bushing.

It is another object of the invention to provide a structure which provides multiple conduction paths between the support member and the conduction member.

It is another object of the invention to provide a grounding lug including a conduction member which is deformed in response to tightening the lug to a bushing, or the like, to enhance contact and conductivity between the conduction member and the support member, as well as between the conduction member and the bushing.

BRIEF DESCRIPTION OF THE DRAWING

Further objects and advantages of the invention will become apparent as the following description is considered, together with the accompanying drawing, in which:

FIG. 3 comprises a front view of the support member after it has been formed by bending;

FIG. 3A comprises a top view of FIG. 3;

FIG. 3B comprises a side view of FIG. 3 and includes a clamping screw;

FIG. 3C comprises a cross-section view of FIG. 3 taken on the line C—C;

FIG. 3D comprises a cross-section view of FIG. 3 taken on the line D—D;

FIG. 4 comprises a side view of an assembled lug coupled to a bushing;

FIG. 4A comprises a partial top view of FIG. 4 showing the relationshp of critical parts as they are first assembled;

FIG. 4B is similar to FIG. 4A but shows the relationship of the same critical parts subsequent to the application of increased tension in the support screw;

FIG. 4C is a cross section of the bushing of FIG. 4 taken on the line C—C; and FIG. 5 comprises a front view of FIG. 4 but without the laid-in wire.

Elements are given the same identifying number in all views.

DESCRIPTION OF THE PREFERRED EMBODIMENT

It is believed that the novel characteristic and unique aspects of the invention may be most easily appreciated by first considering very briefly the structures as shown in FIGS. 4, 4A, 4B, and 5. As shown in FIG. 4, a wire secured in the lug is in direct contact with the two principal members of the lug comprising the support member and the conduction member. In addition, as will be explained more fully hereinbelow, the conduction member is in physical contact with the bushing and secured by the support member. Further, as will be seen hereinbelow when a more complete description is given of FIGS. 4A and 4B, there is good contact between the support member and the conduction member thereby providing an alternate current path. As will be discussed more fully hereinbelow, FIG. 5 illustrates an assembly of the support member and conduction member and illustrates how the support member supports the conduction member.

Figure 1:
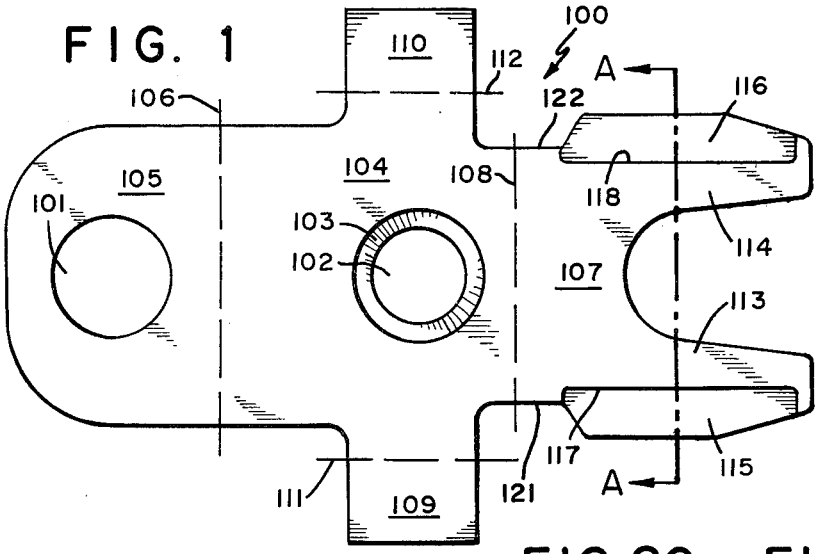
FIG. 1 comprises a view of the support member after it is cut from flat stock but before it is formed.
Figure 1A:
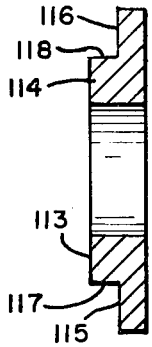
FIG. 1A comprises a cross section of FIG. 1 taken on the line A—A.

Considering now more specifically FIG. 1, there will be seen therein the support member in an early stage of fabrication and indicated generally as 100. As may be seen, the support member 100 is first cut from flat stock which may comprise a stainless steel alloy or any other suitable material. There is a hole 101 which is later threaded for accommodating a screw shown in other figures. There is at least one second hole 102 which accommodates the passage of a mounting screw. The hole 102 may be countersunk as shown at 103 to accommodate a flathead mounting screw. Formation of the support member may be visualized by imagining a total of four bends. For ths purpose, consider that the back portion comprising that part generally surrounding the hole 102 and designated as 104 remaining in the plane of the drawing and that the top portion 105, comprising that part of the support member 100 to the left of the back portion 104, as being bent upwards about the bend line 106 so that the top portion 105 is normal to the plane of the drawing. In a similar manner, consider that the base portion 107, comprising that portion of the support member 100 to the right of the back portion 104 is bent upward about the line 108 so that the base portion 107 is normal to the plane of the drawing and parallel to the top portion 105. The support member 100 includes a left wing 109 and a right wing 110 which are formed by bending about the lines 111 and 112, respectively, so that the wings form an angle approximating 90 to 120 degrees with each other and project below the plane of the drawing. As will be seen, the base portion 107 has legs 113 and 114. As may be seen in FIG. 1A, the legs 113 and 114 include step portions 115 and 116, respectively, which, as will be seen later, provide support for the conduction pad. FIGS. 3 through 3D comprise views of the support member 100 when formed as thus far described. FIG. 3 comprises a drawing of the support member 100 when formed as described with respect to FIG. 1. FIGS. 3A and 3B comprise a top and side view respectively, of FIG. 3. FIG. 3C comprises a section of FIG. 3 taken on the line C—C and FIG. 3D comprises a section of FIG. 3 taken on the line D—D. As may be seen in FIG. 3B, a screw 125 may be threaded into the hole 101 and, as will be seen later, serves to clamp a wire placed in the lug assembly.

Figure 2B:
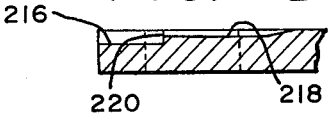
FIG. 2B comprises a partial cross section of FIG. 2 taken on the line B—B.
Figure 2C:
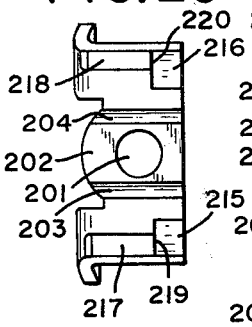
FIG. 2C comprises a back view of FIG. 2 after it has been formed by bending.
Figure 2D:
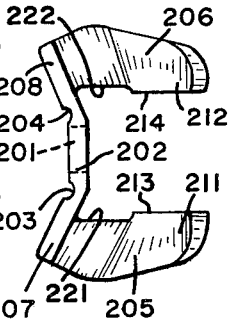
FIG. 2D comprises a top view of FIG. 2 after it has been formed by bending.
Figure 2:
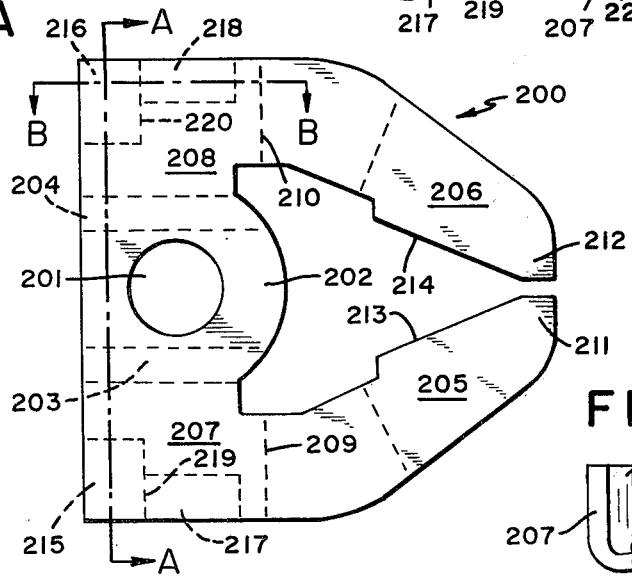
FIG. 2 comprises a view of the conduction member after it is cut from flat stock but before it is formed by bending.

Considering now more specifically FIG. 2, there will be seen therein a conduction member indicated generally as 200 and illustrated in the early stages of fabrication. The conduction member 200 is fabricated of a material such as copper, aluminum, or a suitable alloy which comprises a good electrical conductor. It is a characteristic of metals which are good electrical conductors that they do not have exceptional strength as compared with other metals which are inferior conductors. Accordingly, the lug of this invention comprises two portions—the support member 100 which provides the necessary strength and the conduction member 200 which provides the requisite conductivity. As may be seen in FIG. 2, the conduction member 200 includes a hole 201. The hole 201 is situated in the back section 202 which comprises the portion of the conduction member 200 in the general vicinity surrounding the hole 201. It will be seen later that when the conduction member 200 is formed, the hole 201 is positioned so that when the support member 100 and the conduction member 200 are appropriately positioned with respect to each other, the holes 201 and 101 will be aligned.

Figure 2A:
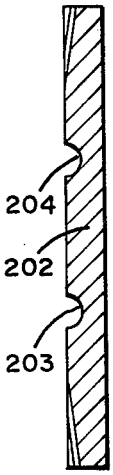
FIG. 2A comprises an end view of FIG. 2 taken on the line A—A.

FIG. 2A comprises a cross section of FIG. 2 taken along the line A—A. As may be seen from a comparison of FIGS. 2 and 2A, the conduction member 200 is formed with slots 203 and 204 which serve the purpose of creating a line about which the conduction member 200 may be bent in response to appropriate forces. FIG. 2B comprises a partial cross section of FIG. 2 taken along the line B—B. As may be seen from a comparison of FIGS. 2, 2A, and 2B, a portion of the reverse side of the conductin member 200 has been modified as by grinding or coining. It will become more evident as the description proceeds that this helps to improve the area of contact between the conduction member 200 and the bushing, or the like, to which it may be affixed and that it provides anti-rotation protection.

The conduction member 200 also includes a left leg section 205 and a right leg section 206. As will become more evident as the description proceeds, the leg sections 205 and 206 will ultimately be oriented and positioned to fit into the left and right steps 115 and 116, respectively, of the support member 100.

Figure 2E:
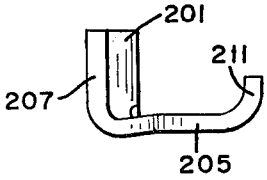
FIG. 2E comprises a side view of FIG. 2 after it has been formed by bending.

As a step in fabricating the conduction member 200, bends will be made at the slots 203 and 204 so that the wings 207 and 208 will form an angle which is somewhat greater than the angle between the wings 109 and 110 of the support member 100 and as illustrated in FIG. 4A. It will be readily perceived that the bending formation described created a left wing 207 and a right wing 208. In addition, the legs 205 and 206 are bent about the lines 209 and 210, respectively, so that they are substantially normal to the back section 202. The conduction member 200 is further formed so that FIGS. 2D and 2E constitute a top and side view of the conduction member 200. It should be observed that in response to the bending formations described, the tips 211 and 212 of the legs 205 and 206, respectively, are separated. The edges 213 and 214 of the legs 205 and 206 are slightly toed out or more distantly separated at the tips 211 and 212 than at the portion closer to the back 202. This facilitates assembly of the conduction member 200 to the support member 100. As may be visualized, the conduction member 200, when formed as illustrated in FIG. 2D, is assembled to the support member 100, as illustrated in FIG. 3D by, for example, positioning portion 221 of member 200 against portion 121 of member 100. From this position member 200 may be pivoted to position portion 222 near portion 122. When the assembly is performed, the edges 213 and 214 will be proximate to edges 117 and 118, but not in contact therewith. Subsequently, when the assembly is mounted on a bushing or the like, as shown in FIGS. 4A and 4B, the wings 207 and 208 will yield and the legs 205 and 206 will move and the edges 117 and 118 will be nearly in contact with edges 213 and 214, respectively. This relationship may be seen in FIG. 5.

FIG. 2C comprises a rear view of FIG. 2D and shows the formed sections 215, 216, 217, and 218. As will be seen, this creates edges 219 and 220 which, as will be perceived more clearly later, mate with an edge on the bushing or the like to which the lug is attached and which serves to inhibit rotation of the lug as it is being secured to the bushing and/or in response to a torque applied to the wire secured in the lug.

When the support member 100 and conduction member 200 are fabricated and formed as heretofor described, they may be positioned in cooperative relationship to produce the assembled lug as illustrated in FIGS. 4 and 5. When thus assembled, it may be seen from a careful analysis of FIGS. 4A and 4B that the back section 202 of the conduction member 200 is positioned behind the back portion 104 of the support member 100. Typically the lug will be assembled on a bushing, or the like, shown generally as 300 in FIG. 4. FIG. 4C illustrates a cross section of the bushing 300 taken along the line C—C of FIG. 4. The assembled lug may be secured to the bushing 300 by means of screw 225 and in response to tightening of the screw 225 the rear side of the back portion 104 is pressed against the front side of the back section 202 thereby providing good contact therebetween.

When the support member 100 and conduction member 200 are assembled together and the screw 225 turned just enough to secure the assembly to the bushing 300, the wing portions 109 and 110 will not be in contact with the wing sections 207 and 208. However, in response to increased tension in the screw 225, the conduction member 200 will be deformed along the slots 203 and 204 to increase the angle between the wing sections 207 and 208 and bring them into contact with the wing portions 109 and 110, respectively. At the same time, the legs 205 and 206 will move towards each other and the edges 213 and 214 will become approximately parallel and be proximate to, the edges 117 and 118, respectively. The deformation of the conduction member 200 is a result of the tightening of the screw 225 combined with the relationship between the radius of curvature of the bushing 300 and the original angle between the wing sections 207, 208. The final result is as illustrated in FIG. 4B wherein the strong support wings 109 and 110 press the conduction wing sections 207 and 208 into good contact with the metallic bushing 300. At the same time, the pressure between the back section 202 and the back portion 104 is increased to improve the conduction therebetween. Also, as described above, the edges 213 and 214 are brought to close proximity, with edges 117 and 118, respectively, and the legs 205 and 206 rest on the steps 115 and 116, respectively.

In describing the configuration of the conduction member, it was pointed out that there are sections 215, 216, 217, and 218. Considering the cross section of the bushing 300 and the ledge 301, it will be appreciated that the edges 219 and 220 of the conduction member mate with the ledge 301 of the bushing 300 to inhibit rotation of the lug assembly relative to the bushing. The screw 311 is used to secure the bushing 300 to a conduit, not shown, or other member.

In order to more clearly distinguish between the conduction member 200 and the support member 100 in the view of FIG. 5, those portions of the conduction member 200, which may be seen, have been indicated with shading lines.

FIG. 4 illustrates a wire 310 which may comprise a plurality of individual strands laid into the lug and pressed into firm contact with the legs 205 and 206 of the conduction member 200. The legs 205 and 206 are, as explained above, supported by the legs 113 and 114, respectively. The plane of the base portion 107 is slightly lower than the plane of the legs 205 and 206; and therefore, in response to the tightening of screw 125 the wire 310 is slightly deformed thereby increasing the force that would have to be applied to pull the wire from the lug. In addition, the configuration of the curvature of the legs 113, 114, 205, and 206 and the placement of the screw 125 is such as to apply a force to urge the wire 310 into contact with the back portion 104 of the support member 100. With the installation completed and the wire in place, the major current path from the wire 310 to the bushing 301 is directly from the wire 310 through the leg sections 205 and 206 through the low resistance conduction member 200 to the wing sections 207 and 208 to the bushing 300. As already recited, the wing sections 207 and 208 are firmly pressed against the bushing 300 by the wing portions 109 and 110 of the support member 100. A subordinate but important current path is from the wire 310 to the back portion 104 and through the wall thereof to the back section 202 and by conduction through the conduction member to the wing sections 207 and 208 to the bushing 300.

Some current may also flow from the wire 310 to the bushing 300 via screw 225. However, since the other paths are lower resistance, relatively little current flows through the screw 225 and there is no danger of its melting to cause loss of the grounding connection. Some current may also flow from the wire 310 through the base 107 to the wings 109 and 110 and then to wings 207 and 208 to the bushing 300. This is a relatively high resistance circuit and only relatively small currents are to be expected.

It has been stated that the support member 100 is made of a high-yield strength material. However, it should be understood that the legs 113 and 114 constitute cantilevers and will deflect in response to tightening screw 125. Accordingly, if the conductor 310 should experience any cold flow, the pressure on the wire will not be significantly reduced as the stored energy in the cantilever legs 113 and 114 will maintain pressure on the wire.

It will be evident to those familiar with grounding lugs that they may be made in a variety of sizes with each size designed to accommodate a limited range of wire sizes.

While there has been shown and described what is considered at present to be the preferred embodiment of the invention, modifications thereto will readily occur to those skilled in the related arts. For example, in another structure, modification could be made for securing the lug to a planar surface or to a concave surface. In addition, modification could be made to provide a plurality of screws 125 and/or 225. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the true spirit and scope of the invention.

What is claimed is:

1. A lay-in grounding lug to be secured to a bushing, or the like, and comprising in combination:

(a) a body member fabricated of a high yield strength material and including a back portion from which top and bottom portions extend forward and substantially normal to said back portion and at opposite ends thereof;

(b) said bottom portion including leg portions extending therefrom;

(c) said body member further including a wing portion extending from each side edge of said back portion with each said wing extending at an angle backwards with respect to said back portion;

(d) a conduction member fabricated of a material having a low yield strength and superior electrical conducting characteristics both as compared with said body member;

(e) said conduction member including a back section with a wing section extending from each side edge of said back section and at an angle backwards with respect to said back section;

(f) each of said wing sections including a leg section extending from an edge of their respective wing sections and projecting forward and substantially normal to the plane of said back section; and wherein (g) said members, portions, sections, and angles are proportioned with respect to each other so that the forward side of said back section and the rearward side of said back portion can make mating contact when said body member and said conduction member are appropriately juxtaposed.

2. The combination as set forth in claim 1 wherein said wing portions and wing sections are not in mutual contact when said body member and said conduction member are juxtaposed as described.

3. The combination as set forth in claim 2 wherein the thickness of said conduction member is reduced at the junction between said back section and each wing section for permitting angular adjustment of said wing sections with respect to said back section without any significant distortion of said back section.

4. The combination as set forth in claim 3 wherein said leg portions include support portions for supporting said leg sections when said body member and said conduction member are juxtaposed as described.

5. The combination as set forth in claim 4 and including aligned mounting holes through said back portion and said back section.

6. The combination as set forth in claim 5 and including a threaded hole through said top portion and a threaded bolt in engagement therewith for clamping a conductor laid on said leg sections in contact with said leg sections and said back portion.

7. The combination as set forth in claim 1 wherein the angle between said back section and said wing sections must be altered to permit contact between said wing portions and said wing sections when said members are juxtaposed as described.

8. The combination as set forth in claim 7 and including aligned mounting holes through said back portion and said back section for the passage therethrough of a mounting bolt to engage a bushing or the like and secure said grounding lug thereto.

9. The combination as set forth in claim 8 wherein said lug is mounted on a bushing, or the like, having a radius of curvature which permits the ends of said wing sections to contact said bushing, or the like, but inhibits contact between said back section and said bushing.

10. The combination as set forth in claim 9 wherein the thickness of said conduction member is reduced at the junction between said back section and each wing section for permitting angular adjustment of said wing sections with respect to said back section.

11. The combination as set forth in claim 10 wherein in response to securing said lug to said bushing by said mounting bolt, sufficient force may be applied to adjust the angle of said wing sections with respect to said back section to increase the pressure between said back section and said back portion and to bring said wing portions into contact with said wing sections.

12. The combination as set forth in claim 11 and including a threaded hole through said top portion and a threaded bolt for engagement therewith for clamping a conductor laid on said leg sections in contact with said leg sections and said back portion.

13. The combination as set forth in claim 12 wherein said body member has resilient characteristics which serve to maintain said conductor clamped in contact with said leg sections and said back portion irrespective of some cold flow of said conductor.

14. The combination as set forth in claim 8 wherein said conduction member includes anti-rotation means cooperating with said bushing, or the like, for inhibiting the rotation of said lug about the axis of said mounting bolt.

15. The combination as set forth in claim 14 wherein said anti-rotation means comprises mating discontinuities in said wing sections and said bushing or the like.

* * * * *